United States Patent [19]

Rooz et al.

[11] Patent Number: 5,043,705

[45] Date of Patent: Aug. 27, 1991

[54] METHOD AND SYSTEM FOR DETECTING A MOTIONLESS BODY IN A POOL

[76] Inventors: Elkana Rooz, 4, Smilansky Street, Herzliya 46366; Isaac Ben-Sira, 39B Burla Street, Tel Aviv 69364, both of Israel

[21] Appl. No.: 434,210

[22] Filed: Nov. 13, 1989

[51] Int. Cl.[5] ..... G08B 13/16; G08B 13/18; G08B 21/00

[52] U.S. Cl. ..... 340/573; 340/552; 340/553; 340/554; 367/93; 367/94

[58] Field of Search ..... 340/573, 554, 553, 552; 367/93, 94

[56] References Cited

U.S. PATENT DOCUMENTS

| | | | |
|---|---|---|---|
| 2,783,459 | 2/1957 | Lienau et al. | 367/93 |
| 3,732,556 | 5/1973 | Caprillo et al. | 340/566 |
| 3,796,208 | 3/1974 | Bloice | 340/573 |
| 3,953,843 | 4/1976 | Codina | 340/539 |
| 3,969,712 | 7/1976 | Butman et al. | 367/136 |
| 4,337,527 | 6/1982 | Delagrange et al. | 367/94 |
| 4,510,487 | 4/1985 | Wolfe et al. | 340/573 |
| 4,639,902 | 1/1987 | Leverance et al. | 340/552 |
| 4,747,085 | 5/1988 | Dunegan et al. | 340/573 |
| 4,775,854 | 10/1988 | Cottrell | 340/573 |

FOREIGN PATENT DOCUMENTS 8821737 2/1989 Australia .

*Primary Examiner*—Glen R. Swann, III
*Attorney, Agent, or Firm*—Browdy and Neimark

[57] ABSTRACT

At least a bottom layer of a swimming pool is continuously scanned at known time intervals in order to generate successive frames of image data containing the contours of all objects whose size exceeds a predetermined size threshold. Successive frames of image data are compared in order to identify those contours which are common to successive frames and whose displacement from one frame to the next is less than a predetermined threshold. This procedure is repeated over successive frames and, since the time interval between one frame and the next is known, a contour which remains substantially motionless for longer than a predetermined time interval may be detected. Such a contour represents a motionless body, on detection of which an alarm is activated. An apparatus according to the invention includes a sonar detector located at the bottom of the swimming pool for scanning the bottom layer thereof so as to produce image data which is subsequently processed by image-processing means. The invention also envisages scanning an upper layer of the swimming pool in order to detect a motionless body which is floating.

10 Claims, 3 Drawing Sheets

METHOD AND SYSTEM FOR DETECTING A MOTIONLESS BODY IN A POOL

FIELD OF THE INVENTION

This invention relates to a method and system for detecting a drowning body in a pool.

BACKGROUND OF THE INVENTION

When a person sinks to the bottom of a pool of water, or even floats unconscious on the surface thereof, his lungs cease functioning and his brain is therefore deprived of oxygen. If this situation is allowed to continue for more than a few minutes, irreparable damage will be done to the brain even if resuscitation is effected. However, if the drowning person is detected quickly and extracted from the water, there is still a very short time period during which resuscitation is possible without permanent damage. Thus, rapid detection and identification of a drowning body is essential if resuscitation is to be at all possible and if permanent damage is to be avoided.

Clearly, detection of a drowning body which remains floating on the surface of the water may easily be effected manually by means of a life-guard, when present. Detection at the bottom of the swimming pool is rendered more difficult partly because it demands on the clarity of the water and also because when many people are swimming in a pool at the same time, it is difficult for a life-guard to monitor everybody's safety effectively.

Hitherto proposed methods and systems for determining swimmers in distress are generally based on detecting disturbances in the water and actuating a suitable alarm when such disturbances are detected. Such an approach is also used in order to monitor unauthorized entry into a swimming pool and to provide an alarm in the event of such unauthorized entry.

Thus, for example, U.S. Pat. No. 3,969,712 (Jerry et al.) discloses a device adapted to float in a swimming pool and sound an alarm when the water is disturbed and which includes a transducer for sensing noise in the water. The device is particularly sensitive to disturbances which are reflected off the walls of an average size swimming pool, other noises not being of interest and being filtered out.

Similarly, U.S. Pat. No. 3,953,843 (Codina) discloses a pool alarm system which includes a transmitter adapted to float on the surface of the water. When activated by a wave produced by a suitable disturbance, the transmitter emits a signal which is subsequently detected by a radio receiver which itself is coupled to an alarm which emits an audible signal.

Likewise, Australian Patent No. 8,821,727 (Webb) discloses a warning device for detecting the presence of a person in a pool of water and for detecting disturbances therein. When disturbances are detected and also a person is located within the swimming pool, an alarm is sounded. On the other hand, if disturbances are located but nobody is swimming in the pool, the alarm is disabled.

In contrast to the above patent, U.S. Pat. No. 3,732,556 (Caprillo et al.) discloses a swimming pool alarm system which provides an alarm as soon as a person or an object falls into the water. Caprillo et al. make no attempt to discriminate between a swimmer and an object and is intended primarily to protect against unauthorized tampering with the pool.

Thus, it will be apparent, that existing systems are intended to provide a warning in the event of unauthorized disturbances within the swimming pool. Clearly, such systems are effective only when the pool is empty. People swimming in the pool inevitably cause disturbances which require that alarm systems of the type described be disabled in order to prevent them from operating. Thus, alarm systems of this type are primarily intended to protect domestic swimming pools or even public swimming pools when they are not in use and the life-guard is absent.

The purpose of such alarm systems is generally to protect against unforeseen slipping into the water and to provide a warning that someone has entered the pool when it is, as yet, unauthorized for use. Specifically, systems of the type described exist which produce a warning signal when for example, small children slip into the water or when someone falls in as a result of darkness and is unable to climb out unaided.

Such systems are limited to detecting unforeseen disturbances within the pool and are not suitable for detecting the presence of somebody who is actually drowning. This is due, in part, to the fact that such systems must be disabled when the pool is authorized for use. If this is not done, then a drawback of prior art systems is that a false alarm will be produced. A further drawback is the incidence of false alarms as a result of non-human objects falling into the water and, indeed, the general inability of such systems to discriminate between human and non-human bodies. Even more significant is the inability of such systems to discriminate between swimmers, be they authorized or not, who have entered the pool and are experiencing difficulty from those who have entered the pool but are not in danger.

Observations of people drowning permit discrimination between such people and other bodies in the water. In particular, drowning bodies fall into two categories: most bodies which drown do so because, usually as a result of prior difficulties, the lungs absorb large quantities of water and the specific weight of the body becomes greater than that of water. In these cases, the body starts to sink and after a very short time period will settle unconscious at the bottom of the pool. Less commonly, it may happen that a swimmer loses consciousness before the lungs become full of water and, in these cases, the specific weight of the body remains less than that of the water and the body floats unconscious on the surface of the water. In either case, the violent disturbances which are caused by swimmers in distress are absent and, therefore, methods and systems which exploit such disturbances in order to detect a drowning person will not be effective.

BRIEF SUMMARY OF THE INVENTION

It is an object of the invention to provide a method and system for detecting a drowning body in a pool in which the drawbacks associated with hitherto proposed methods and systems are significantly reduced or eliminated.

It is a specific object of the invention to provide a method and system which are operable during normal, authorized use of a swimming pool to provide an alarm in the event that a swimmer is drowning.

These and other objects are provided in accordance with the invention by:

(a) scanning at least one layer of the pool bounded by a surface thereof at predetermined time intervals so as to accumulate successive frames of data corresponding to all objects lying in said at least one layer;

(b) for each frame of data:

(i) removing background noise, (ii) detecting all objects whose size exceeds a first predetermined threshold, and (iii) determining and storing for each object detected in (b)(ii) its contour and location;

(c) for successive frames of data:

(i) comparing for each object detected in (b)(ii) its location in said successive frames so as to detect all objects whose displacement between said successive frames is less than a second predetermined threshold, (ii) determining for each object detected in (c)(i) an elapsed time during which its cumulative displacement is less than said second threshold, and (iii) actuating an alarm if said elapsed time exceeds a third predetermined threshold.

Thus the method and apparatus according to the invention effect rapid detection of all bodies on the lower and upper surfaces of a swimming pool and, moreover, discriminate between a swimmer who is actually drowning and one who is merely floating on the surface of the water or swimming underwater for any length of time. This discrimination is rendered possible by detecting all objects on the lower and upper surfaces of the pool which remain motionless for longer than a predetermined time interval. This approach is diametrically opposed to hitherto proposed pool alarms which are based on the detection of motion, i.e. disturbances within the water.

BRIEF DESCRIPTION OF THE DRAWINGS

The invention will now be described, by way of non-limiting example only, with regard to a method and system for detecting a drowning body in a swimming pool and with reference to the accompanying drawings, in which.

DETAILED DESCRIPTION OF A PREFERRED EMBODIMENT

Figure 1:
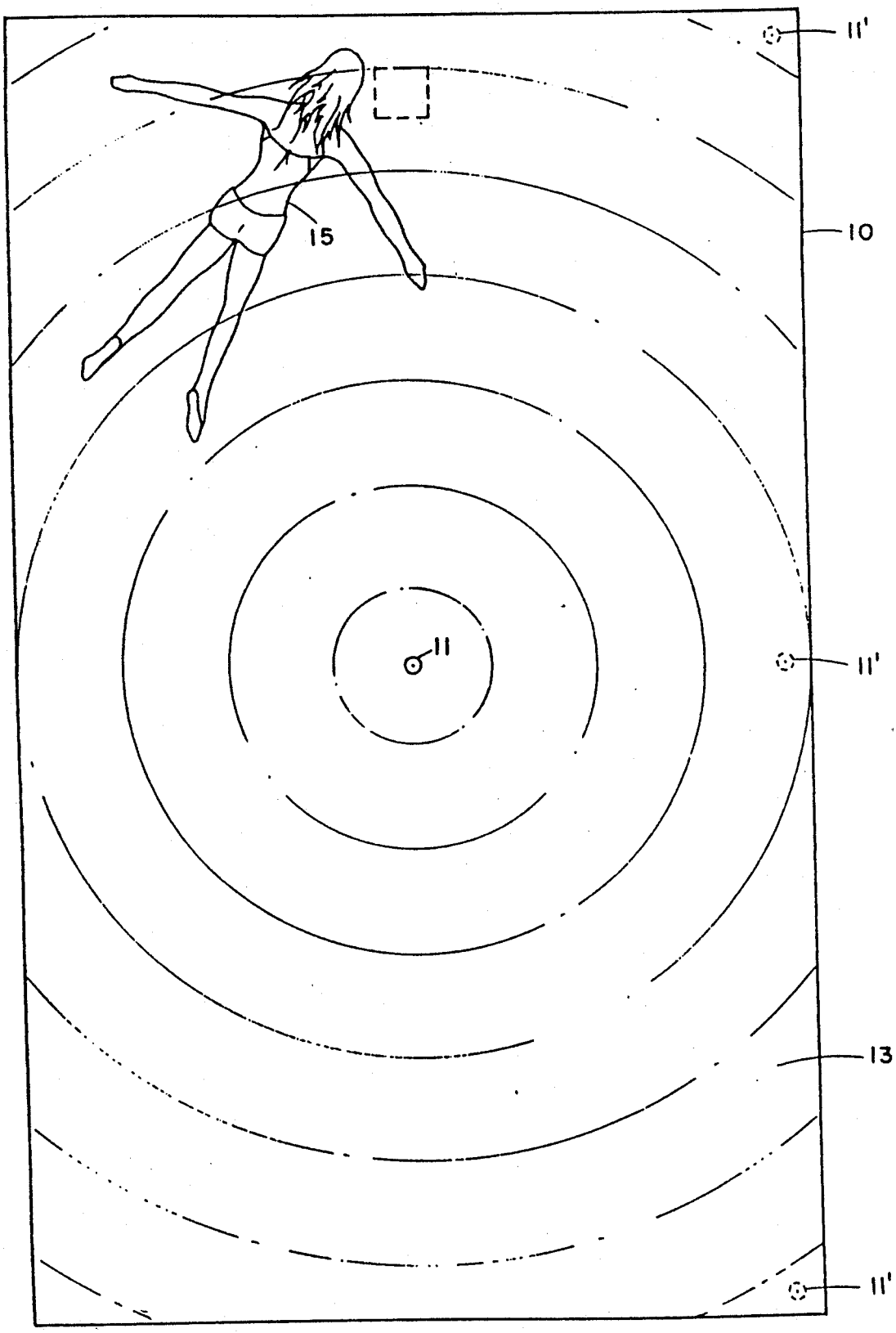
FIG. 1 shows schematically a plan view of a swimming pool illustrating a system according to the invention.

Referring to FIG. 1 there is shown schematically a plan view of a swimming pool 10 at the centre of which is located a sonar detector 11 adapted to effect circular scanning of the pool. The sonar detector 11 is fixed to the bottom of the pool 10, constituting a lower surface 13 of the pool and is adapted to circularly scan a layer of the pool bounded by the lower surface 13 in known manner.

Also shown is a swimmer 15 resting on the lower surface 13 of the pool 10 so as to be detected by the sonar detector 11. The sonar detector 11 is an active device which emits a beam in the form of a succession of pulses and deteets the echo of the pulses caused by their reflection from an obstacle in the path of the beam.

Thus, in FIG. 1, by measuring the time between the emission of a pulse and its subsequent detection by the sonar detector 11, the distance of the body 15 from the sonar detector 11 may be calculated. Furthermore, since the sonar detector 11 emits a continuous stream of pulses whilst effecting circular scanning of the pool 10, the distance from the sonar detector 11 to all points on the outline of the body 15 may be measured and this, in turn, enables the contour of the body 15 to be determined.

In reality, it may well happen that successive pulses emitted by the sonar detector 11 are reflected by different objects lying on the lower surface 13 of the pool 10. In these circumstances, successive distances from the sonar detector 11 to the respective objects do not relate to a single contour and, so far as the first contour is concerned, the second pulse constitutes "noise" since it does not permit a point on the first contour to be determined accurately. Other types of noise may also occur due, for example, to background currents within the water produced by streams of fresh water entering the pool.

Figure 2:
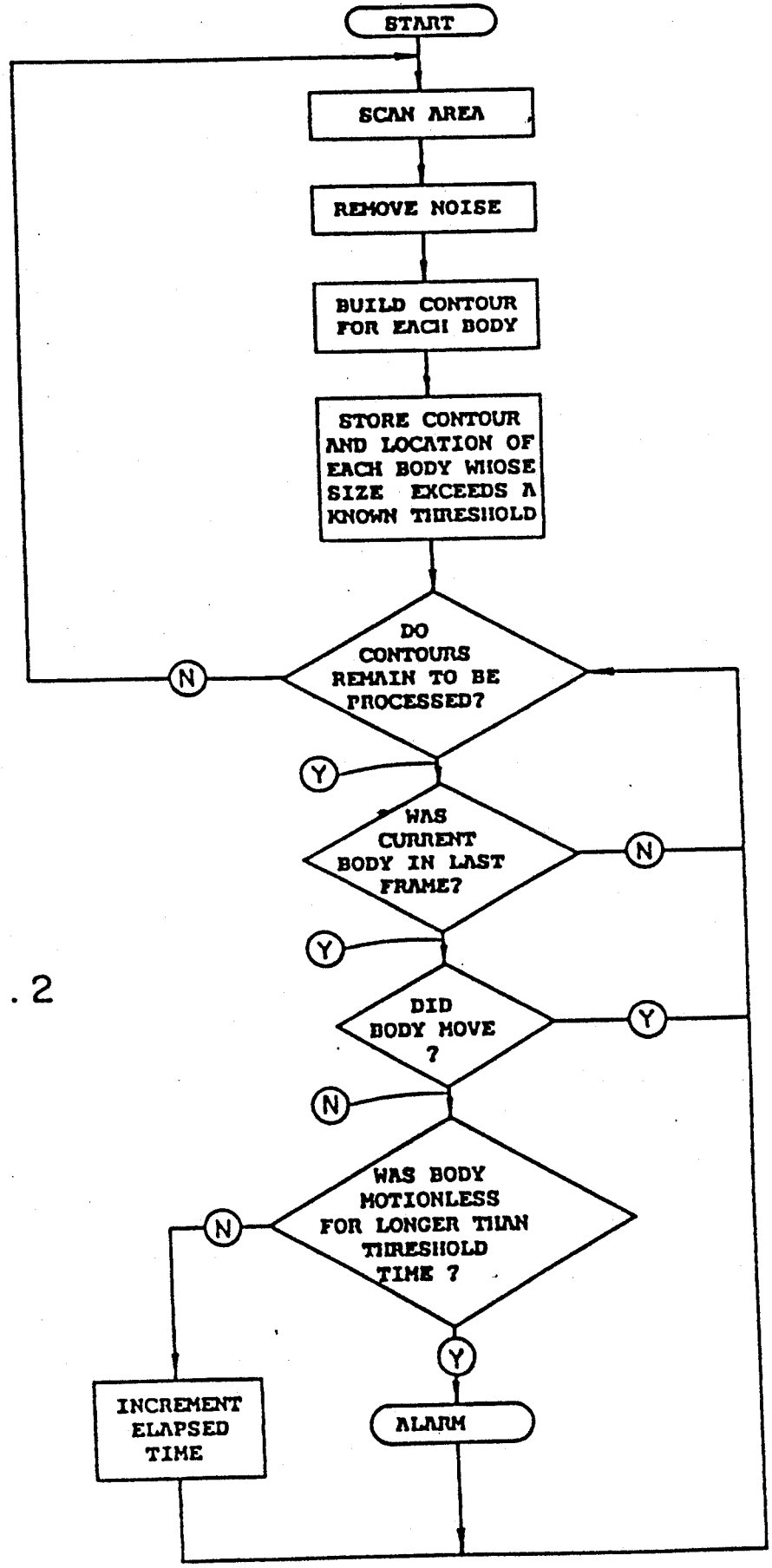
FIG. 2 shows a flow diagram of a method according to the invention.

Referring now to FIG. 2 of the drawings, there are shown the main steps in a method according to the invention for processing the information produced by the sonar detector 11 shown in FIG. 1. It will be apparent that for each scan of the sonar detector 11 there is produced a frame of data relating to all bodies lying on the lower surface 13 of the pool 10. The data generally contains noise, as explained above, and the noise must first be removed. Thereafter, a contour is determined for each object lying on the lower surface 13 of the pool 10 and from the contours, the size of each object may be calculated. Since it may well be that some of the contours relate to non-human objects which have been thrown into the pool, it may well be that not all objects are of interest, in which case such objects may be discarded thereby increasing the subsequent processing.

A suitable criterion for discriminating between human bodies and other objects is their size, particularly since the size of the objects may easily be calculated from a knowledge of its contour. Therefore, the size of each detected object is calculated and only those contours are stored for subsequent processing whose size exceeds a predetermined threshold.

Thus, successive frames of data are generated, each representing an image containing all objects larger than a predetermined size and corresponding to bodies lying on the lower surface of the pool. The contours in each image are arranged spatially in exact correspondence to the bodies which they represent and thus correspond to a picture of all swimmers on the lower surface of the pool frozen in action at the instant of the respective scan.

It will be understood that the scans are effected successively at predetermined intervals of time so that the time interval from one frame to a successive frame is known. By this means, it is possible to process successive frames of image data so as to identify all contours which are common to both frames of image data and to determine the displacement of each identified contour from one frame to the next. When the measured displacement is less than a predetermined threshold, this indicates that the detected body has remained substantially motionless between successive frames. By repeating this process over any desired number of frames, it is possible to detect all bodies which have remained substantially motionless for a predetermined time interval corresponding to the time required to produce the respective number of frames of image data.

When an object is detected which is both larger than the predetermined size threshold and remains substantially motionless for longer than the predetermined time interval threshold, an alarm is activated so as to provide a suitable warning to a life-guard or other supervisory personnel.

Figure 3:
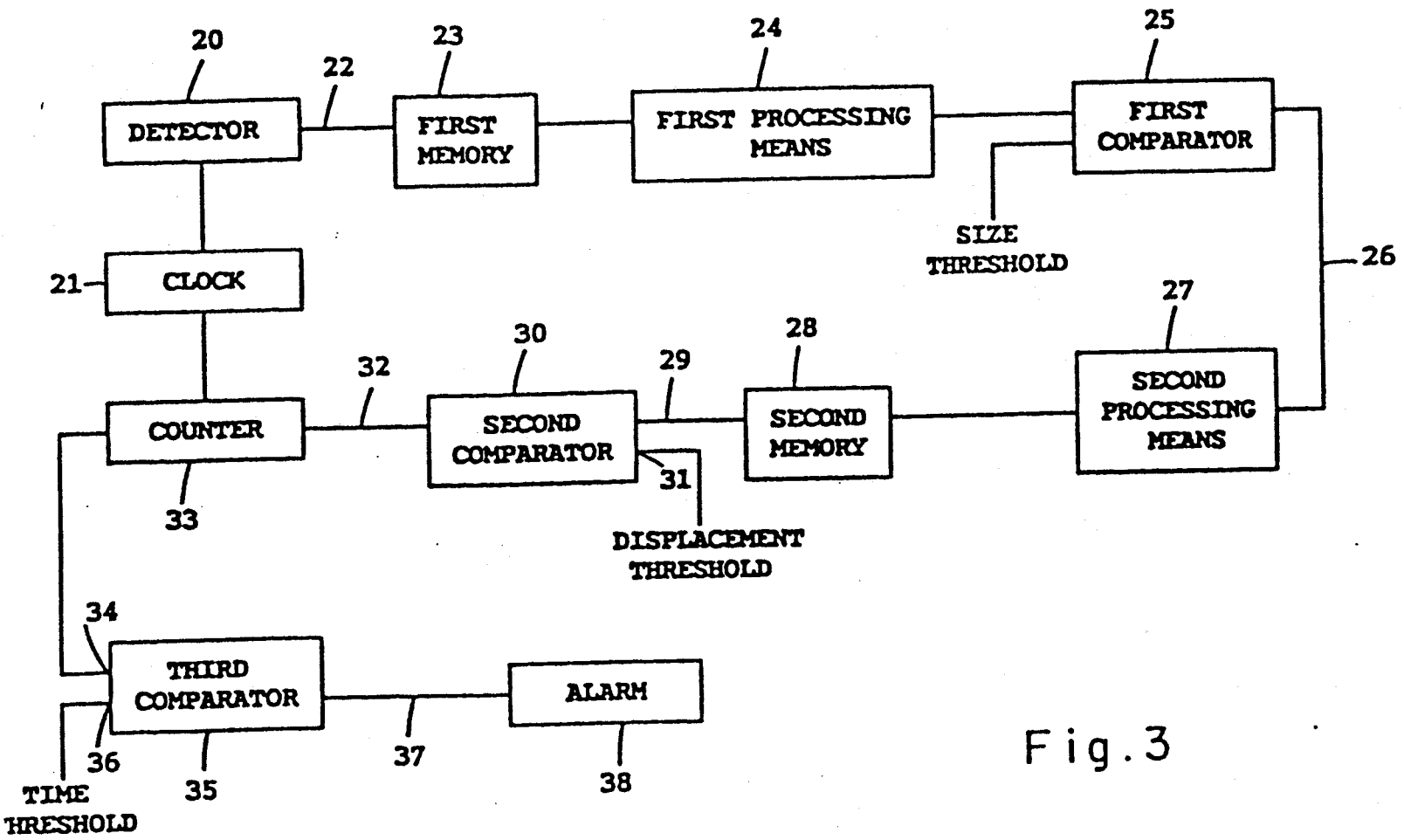
FIG. 3 shows functionally a block diagram of a system according to the invention.

Referring now to FIG. 3 of the drawings there will be described functionally a system in accordance with the invention. A DETECTOR 20 receives timing signals from a CLOCK 21 so as to scan a surface of a swimming pool at regular time intervals. An OUTPUT 22 of the DETECTOR 20 is coupled to a FIRST MEMORY 23 which stores successive frames of image data corresponding to all objects lying on the scanned surface of the pool. The FIRST MEMORY 23 is coupled to a FIRST PROCESSING MEANS 24 which processes the image data so as to remove therefrom background noise and to determine the size of each object. The FIRST PROCESSING MEANS 24 is coupled to a FIRST COMPARATOR 25 which compares, for each object, its size relative to a predetermined size threshold.

An OUTPUT 26 of the FIRST COMPARATOR 25 is coupled to a SECOND PROCESSING MEANS 27 which determines the contour and location of all objects whose size exceeds the size threshold. The SECOND PROCESSING MEANS 27 is coupled to a SECOND MEMORY 28 which stores the contour and location of each object whose size exceeds the size threshold. The SECOND MEMORY 28 is fed to one INPUT 29 of a SECOND COMPARATOR 30 whose second INPUT 31 corresponds to a predetermined displacement threshold. The SECOND COMPARATOR 30 compares for each object stored in the SECOND MEMORY 28 its location in successive frames so as to detect all objects whose displacement between successive frames is less than the predetermined displacement threshold.

An OUTPUT 32 of the SECOND COMPARATOR 30 is coupled to a COUNTER 33 which receives timing signals from the CLOCK 21 so as to determine for each object which is effectively motionless between successive frames, an elapsed time during which its cumulative displacement is less than the displacement threshold. The COUNTER 33 is coupled to one INPUT 34 of a THIRD COMPARATOR 35 whose SECOND INPUT 36 corresponds to a predetermined time threshold. The THIRD COMPARATOR 35 compares the elapsed time at its INPUT 34 with the time threshold at its INPUT 36 so as to generate a signal at an OUTPUT 37 of the THIRD COMPARATOR 35 in the event that the elapsed time exceeds the time threshold.

An ALARM 38 is coupled to the THIRD COMPARATOR 35 and is responsive to its OUTPUT 37 for emitting an alarm signal if the elapsed time exceeds the time threshold.

It will be apparent that the system described functionally with reference to FIG. 3 may be implemented in many ways using either discrete logic elements or, alternatively, a suitably programmed computer.

It will also be apparent that, whilst the invention has been described with particular regard to a detector located at the lower surface of a swimming pool, an additional detector may also be provided at the upper surface of the pool. Such a detector may take the form of a floating detector suitably anchored so as to prevent motion thereof or, alternatively, an array of detectors may be provided at a side of the swimming pool.

Likewise, the single sonar detector 11 may be replaced by an array of detectors 11 located at a side of the swimming pool 10, each detector in the array being adapted to scan a predetermined volume of water bounded by a lower or upper surface of the pool. Similarly, a single detector may be provided adapted for linear movement along a side of the swimming pool 10 for effecting the required scanning.

It has been found that sonar detectors exhibit particular advantages when used in a system according to the invention, since their attenuation in water is relatively small as compared with other types of detectors such as, for example, radio frequency (r.f.) detectors. Nevertheless, r.f. detectors as well as laser detectors can equally be employed in a system according to the invention.

Furthermore, although the invention has been described with respect to an echo system whereby distances are determined by measuring the time interval between a pulse being emitted and its echo being received, it will be apparent that any system which permits determination of the distance of an object from a fixed point, is equally acceptable.

Thus, for example, a Doppler echo system may be provided for generating a signal when a pulse emitted therefrom strikes a moving object. This permits all objects within the scanned volume which do not move to be detected during the scanning stage itself. Only data concerning such objects need be stored, since bodies which are identified as having moved are clearly not at risk. Consequently, provision of a Doppler system permits rapid elimination of all moving bodies at a preliminary stage which obviates the need for unnecessary post-processing of such objects and results in a faster and more efficient system.

A detailed description of such techniques and of the image processing itself have not been provided since these are not themselves features of the invention. The novelty of the invention lies in identifying a swimmer lying on a lower or upper surface of a swimming pool according to the size of the detected image and in identifying a detected swimmer as drowning in the event that he remains substantially motionless for longer than a predetermined time interval. Such an approach is quite distinct from hitherto proposed pool alarm systems which are based on the detection of disturbances in the water consequent to motion therein.

We claim:

1. A method for detecting a motionless body in a pool, comprising the steps of:

(a) scanning at least one layer of the pool bounded by a surface thereof at predetermined time intervals so as to accumulate successive frames of data corresponding to all objects lying in said at least one layer;

(b) for each frame of data:

(i) removing background noise, (ii) detected all objects whose size exceeds a first predetermined threshold, and (iii) determining and storing for each object detecting in (b)(ii) its contour and location;

(c) for successive frames of data:

(i) comparing for each object detected in (b)(ii) its location in said successive frames so as to detect all objects whose displacement between said successive frames is less than a second predetermined threshold, (ii) determining for each object detected in (c)(i) an elapsed time during which its cumulative displacement is less than said second threshold, and (iii) actuating an alarm if said elapsed time exceeds a third predetermined threshold.

2. A method according to claim 1, wherein a layer bounded only by a lower surface of the pool is scanned.

3. A method according to claim 1, wherein two layers bounded respectively by lower and upper surfaces of the pool are scanned.

4. A system for detecting a drowning body in a pool, said system comprising:

timing means, scanning means coupled to the time means for scanning at least one layer of the pool bounded by a surface thereof at predetermined time intervals so as to accumulate successive frames of data corresponding to all objects lying in said at least one layer, a first memory for storing said data, first processing means coupled to said first memory for processing said data so as to remove background noise and to determine the size of each object, first comparator means coupled to the first processing means for comparing the size of each object with a first predetermined threshold, second processing means coupled to the comparator and responsive to an output thereof for determining for each object whose size exceeds said first threshold its contour and location, a second memory coupled to the second processing means for storing said contour and location, second comparator means coupled to the second memory for comparing for each object its location in said successive frames so as to identify all objects whose displacement between said successive frames is less than a second predetermined threshold, counter means coupled to the second comparator means and to the timing means for counting for each object whose displacement between said successive frames is less than the second threshold an elapsed time during which its cumulative displacement is less than the second threshold, third comparator means coupled to the counter means for comparing the elapsed time with a third predetermined threshold, and alarm means coupled to the third comparator means for emitting an alarm signal if the elapsed time exceeds the third threshold.

5. A system according to claim 4, wherein the scanning means is located toward a lower surface of the pool.

6. A system according to claim 4, wherein the scanning means is located toward an upper surface of the pool.

7. A system according to claim 4, wherein the scanning means includes a detector located at a lower surface of the pool toward the centre thereof.

8. A system according to claim 7, wherein the scanning means further includes an array of detectors located at an upper surface of the pool towards a side thereof.

9. A system according to claim 4, wherein the scanning means includes respective arrays of detectors located at lower and upper surfaces of the pool towards a side thereof.

10. A system according to claim 4, wherein the scanning means includes at least one sonar detector.

* * * * *